United States Patent [19]

Leunbach et al.

[11] 4,199,684

[45] Apr. 22, 1980

[54] METHOD FOR THE DETERMINATION OF THE ELECTRON DENSITY IN A PART VOLUME

[75] Inventors: Ib Leunbach, Vanløse; Kim Demandt, Naerum; Ottar Skilbreid, Lyngby, all of Denmark

[73] Assignee: Scadera A/S, Vedbaek, Denmark

[21] Appl. No.: 914,451

[22] Filed: Jun. 12, 1978

[30] Foreign Application Priority Data

Jun. 29, 1977 [DK] Denmark ..... 2900/77

[51] Int. Cl.[2] ..... H01J 35/00

[52] U.S. Cl. ..... 250/402; 250/403; 250/445 T; 313/55

[58] Field of Search ..... 250/445 T, 401, 402, 250/403, 404, 405; 313/55

[56] References Cited

U.S. PATENT DOCUMENTS

| | | | |
|---|---|---|---|
| 3,106,640 | 10/1963 | Oldendorf | 250/445 T |
| 3,942,015 | 3/1976 | Huxley | 250/406 |

*Primary Examiner*—Craig E. Church

*Attorney, Agent, or Firm*—Ladas, Parry, Von Gehr, Goldsmith & Deschamps

[57] ABSTRACT

The present invention relates to a method for the determination of the electron density in a part volume in a patient by means of an X-ray tube, said tube comprising an anode symmetrical with respect to rotation as an electron beam rotates relative to the axis of rotation. As a result an X-ray emission from several points is obtained. By means of the scattered X-rays the electron densities can be measured.

5 Claims, 5 Drawing Figures

METHOD FOR THE DETERMINATION OF THE ELECTRON DENSITY IN A PART VOLUME

The invention relates to a method for the determination of the electron density in a part volume from the scattering of X-rays supplied from several directions.

Danish Patent specification No. 131,955 describes a method of measuring the electron density by means of one and the same source of emission in several positions. To omit the movement of the source, two sources in connection with a rotating blende can be used.

The method according to the invention is characterised by using an X-ray tube comprising an anode symmetrical with respect to rotation and an electron beam radially deflected and rotating relative to the axis of rotation. As a result mechanical parts or movements of the source are no longer necessary.

The invention also relates to an X-ray tube for carrying out the method according to the invention. The X-ray tube is characterised by comprising an anode symmetrical with respect to rotation and an electron beam radially deflected and rotating relative to the axis of rotation. As a result a particularly advantageous X-ray tube is obtained.

Moreover according to the invention the electron beam may perform a radial sweep having a frequency of at least 10 times the rotary frequency.

It is according to the invention preferred that the sweep is provided by applying a voltage to the anode or to an intermediate anode, said voltage being oscillating relative to the cathode of the tube.

The anode may according to the invention be provided with a graduated surface, thus providing a more efficient utilization of the electron beam.

Furthermore according to the invention the steps may be formed in such manner that they are screened against undesired backward emission. As a result the drawbacks for the user are reduced.

Moreover according to the invention the cross section of the anode may extend along a broken line. As a result an increase of the emission intensity in the marginal zone of the anode is obtained.

Finally according to the invention an X-ray tube with pulsating emission may be used for combined CT- and isotope scanning, whereby the emission periods are used for CT-scanning in accordance with the described method, and the intermediate periods are used for detecting the emission from a radionuclide injected in a patient.

Figure 1:
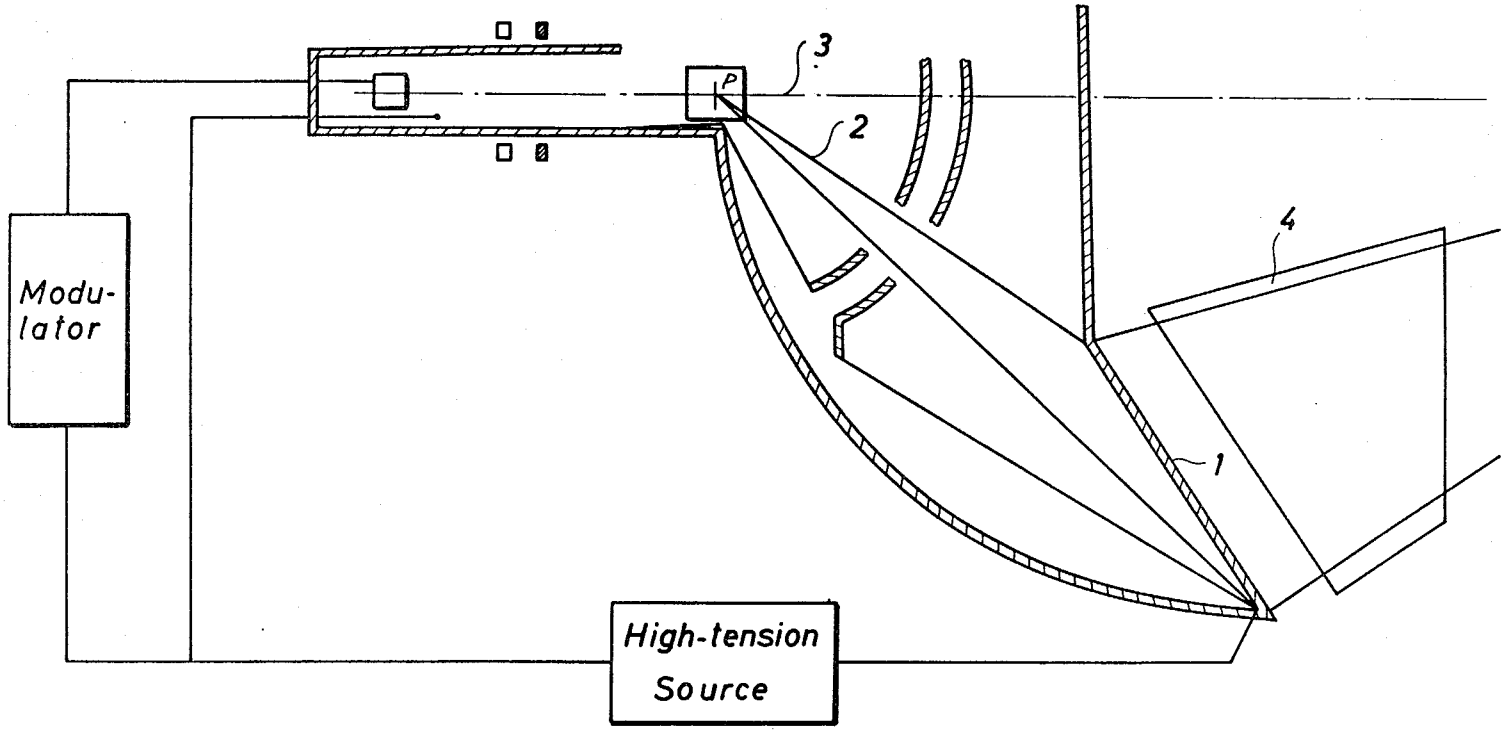
Figure 2:
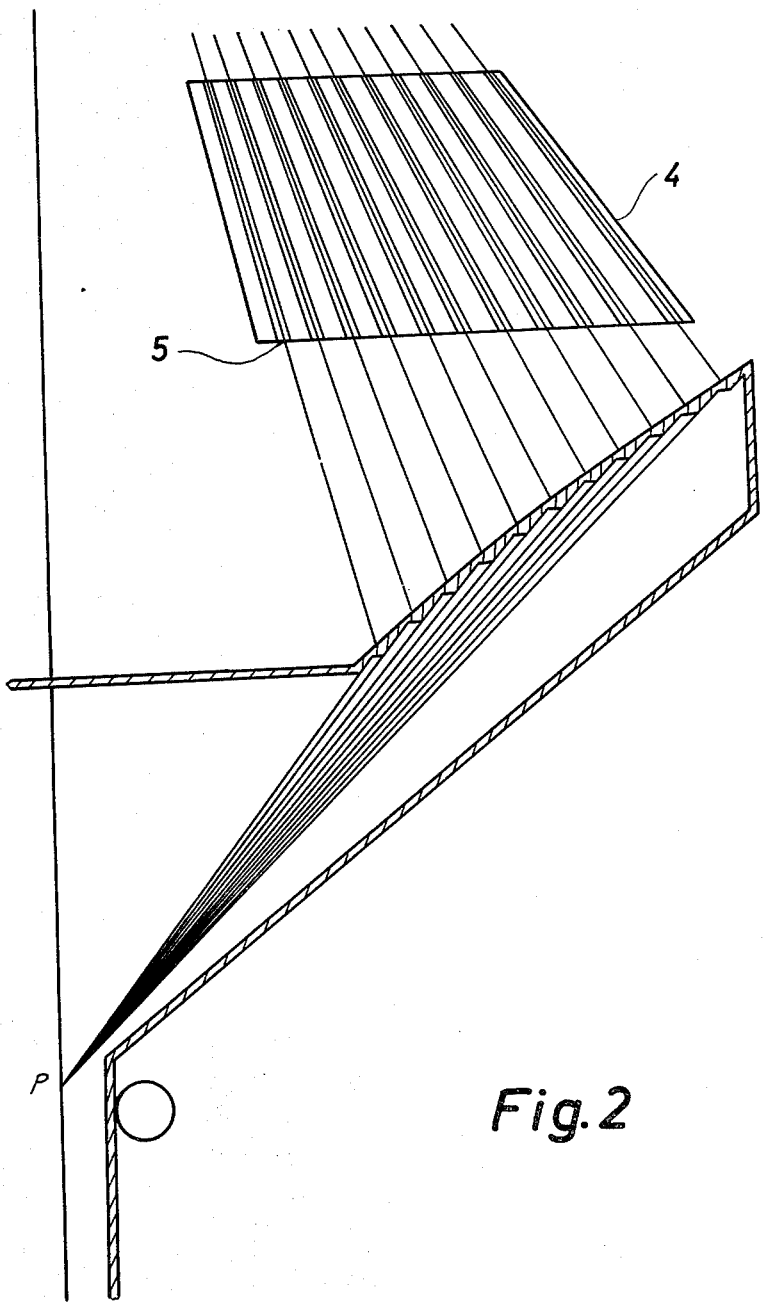
Figure 3:
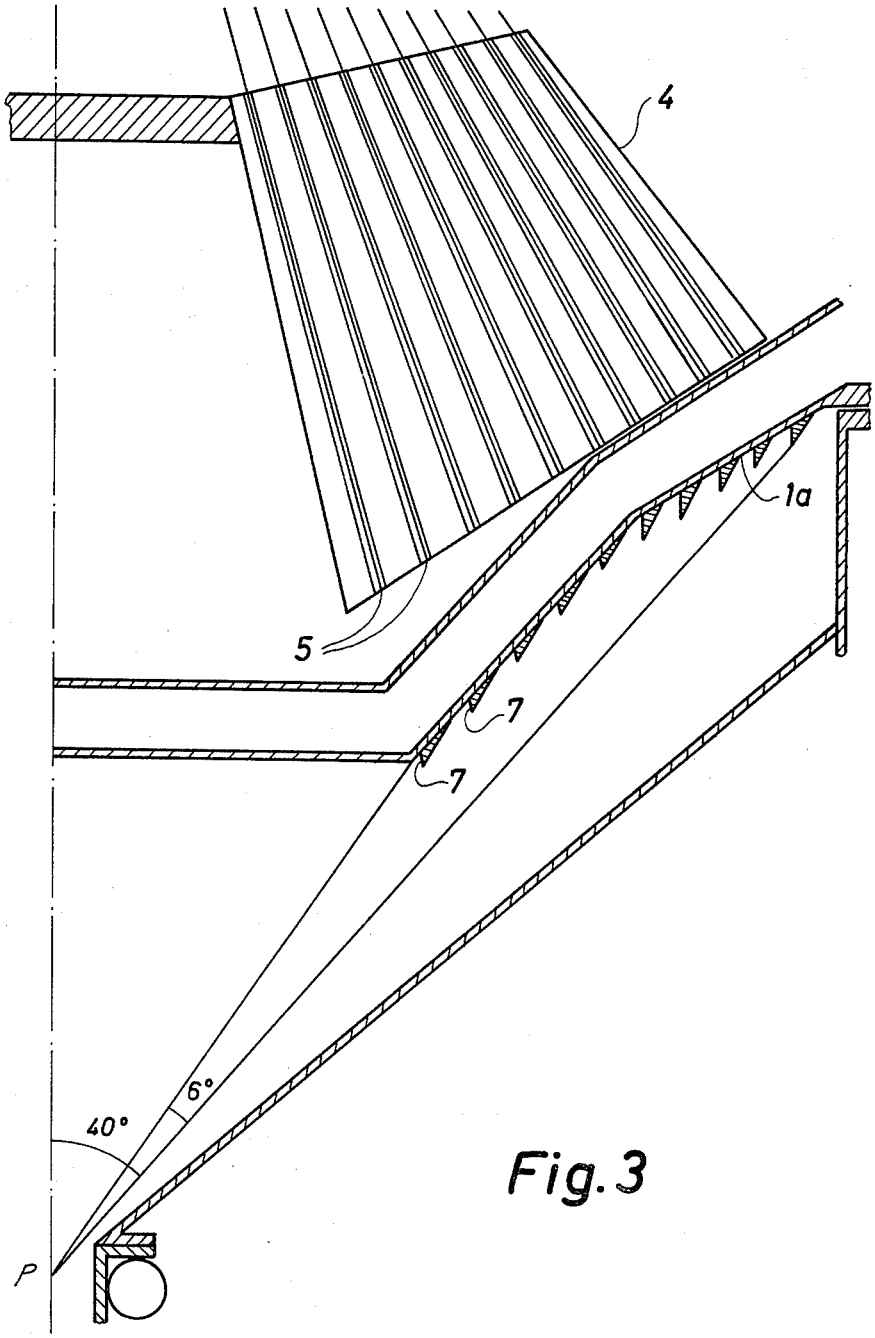
Figure 4:
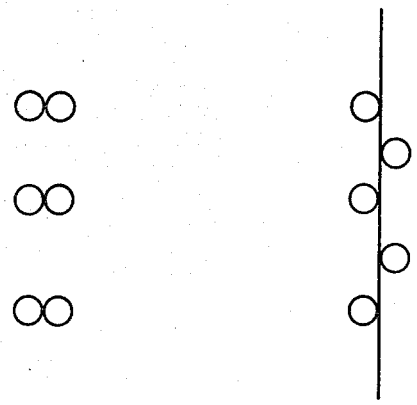
Figure 5:
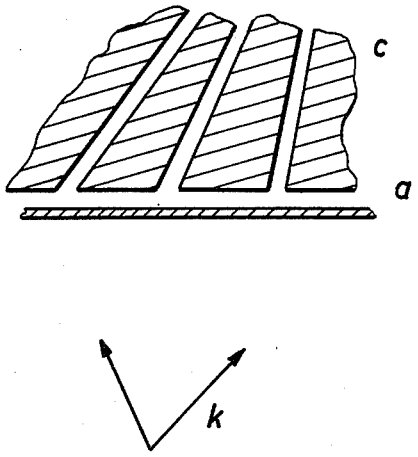

The invention will be described below with reference to the accompanying drawing, in which FIG. 1 is a sectional view of an X-ray tube symmetrical with respect to rotation according to the invention, FIG. 2 illustrates an anode implying that the X-rays are emitted in beams, FIG. 3 illustrates a preferred embodiment of the anode, FIG. 4 an end view of the collimator, and FIG. 5 illustrates the mode of operation of the X-ray tube.

The X-ray tube illustrated in FIG. 1 comprises an anode 1 symmetrical with respect to rotation. The anode is hit by an electron beam 2 rotating about the symmetrical axis 3. The electron beam may either cover a predetermined angle, e.g. 6°, or be swept in radial direction during the rotation. A collimator 4 symmetrical with respect to rotation too and comprising a plurality of equidistantly provided apertures is arranged in front of the anode 1 symmetrical with respect to the axis of rotation 3. These apertures are directed to the same point on the axis of rotation 3. In order to obtain the best possible utilization of the electron beam 2, the surface of the anode 1 facing the electron beam 2 may be graduated, cf. FIG. 2. The X-rays are produced from predetermined deceleration areas aligned with the apertures 5 of the collimator. As a result the electron beam current may be reduced by a factor 2 to 4.

Below the problem will be described in detail. In FIG. 5 the focusing collimator c is composed of a solid block of lead provided with conically formed channels directed towards one and the same point. An anode a is connected to the block of lead. A cathode k is provided somewhat distanced from the anode.

By applying an appropriate voltage between k and a the anode surface emits a deceleration radiation. A part of the anode surface is therefore able to emit X-rays through the apertures of the collimator.

According to the radiometric measuring principle relatively hard X-rays must be used, for which reason the collimator illustrated is only impervious when the lead material or the partition walls between the individual collimator apertures are relatively large. This implies that the opening ratio in the collimator should be small and hardly larger than 25–50%. As a consequence thereof only 25–50% of the surface of the anode is efficient, for which reason the generation of heat and the consumption of milliamperes in the high-voltage generator in principle is 2 to 4 times as large as when the electrons emitted from the cathode had been used 100%.

FIG. 2 illustrates an embodiment of the anode eliminating this problem.

The anode is characterised by being graduated or formed by steps in such manner that the horizontal portion of a step is arranged opposite a collimator aperture, whereas the inclined portion of the step is directed towards the cathode emission point or the deflection point p.

The inclined portion of the step is further characterised by having such a length that it just reaches the adjacent collimator opening where it extends along a horizontal surface corresponding to the collimator aperture.

It now appears that the graduated anode not necessarily comprises horizontally arranged steps opposite the collimator apertures. This portion of the anode may be arbitrarily inclined provided that the active portion of the anode step is substituted by a surface corresponding to the effect that the collimator partition wall aims at the cathode emission point p.

However, the above graduated anode does not solve the problem completely as the problem has only been solved in "one dimension".

FIG. 4 illustrates the collimator seen from the anode surface.

The problem can only be solved in "two dimensions" by making the partition wall in the collimator in one dimension infinitely thin as illustrated in FIG. 4.

This is, however, not satisfactory since the collimator is not impervious due to the thin partition wall in one dimension.

The problem may, however, be solved by "displacing" one radial row of apertures for instance half a step relative to the apertures of the adjacent row, cf. also FIG. 4. Physically seen, the desired septum thickness is obtained at the same time as functionally seen, i.e. seen from the cathode point, the collimator reacts as if the septum thickness is infinitely thin in at least one dimension.

To the right of FIG. 4 the latter solution has been illustrated. This solution requires that the collimator apertures in at least one dimension are situated in such manner that it is impossible to intersect the collimator with a radial plane without said plane intersecting or being in contact with both radially extending collimator apertures as well as involving the adjacent row correspondingly.

In FIG. 3 the method is not illustrated with an emission anode, but on the contrary with a reflection anode. The method is here quite the same since each step may be said to be composed of an inactive portion, the surface of which corresponds to a partition wall and the surface direction of which aims at the cathode. Each step is furthermore composed of an active portion, i.e. the reflecting portion, which may have an arbitrarily inclining direction only restricted by the intersection of the surface corresponding to the intersection of the adjacent partition wall, where it is succeeded by a new inactive surface having the above characteristics.

In a particularly preferred embodiment the anode surface is provided with electron stopping surfaces 7, the major part of which are only able to emit towards the anode, cf. FIG. 3. This minimizes, of course, the backward emission.

The anode may as illustrated in FIG. 2 have a linear cross section. A drawback thereby is, however, that the various portions of the anode as a consequence thereof is irradiated per unit of area by unequally large solid angles of the electron beam 2. In particular the outer portions of the anode 1 are not irradiated as heavy as the inner portions. In order to eliminate this problem, the anode 1 extends preferably along a broken line, cf FIG. 3, in such manner that the outer portion 1*a* of the anode 1 is more inclined towards the angular portion irradiated by the electron beam 2. The cross section of the anode may, of course, also extend along a curve, which, however, makes the manufacture more expensive. The anode may in general be formed in such manner that the intensity of the X-rays from the screen plate between the electron beam and the anode may be regulated corresponding to the demands of the measuring principle.

The anode is besides composed of a steel plate about 2 mm thick.

It is easy to provide the rotation of the electron beam 2. It may in principle be provided by means of two sets of plates perpendicular to each other. A voltage of a.sin(wt) is applied to one set of plates and a voltage of a.cos(wt) is applied to the second set of plates, whereby a is a voltage amplitude and w is an angular frequency.

In practice deflectors are preferred since a better control is obtained by means of deflectors. The deflection relative to the axis of rotation is about 40°. An auxiliary control electrode may provide a sweep in radial direction. The sweep frequency is at least 10 times the rotary frequency.

In a particularly advantageous utilization of the X-ray tube, an X-ray scanning is combined with an isotope scanning in such manner that no doubt arises concerning the area to be irradiated. Isotope scanning a radionuclide injected in a patient is absorbed in some tissues, e.g. in tumours or in the pancreas. This detector system may provide a picture of the distributions of the isotopes, i.e., of the diseases of the patient. The X-ray tube is controlled by initially X-ray radiation in a predetermined number of msec., whereafter a detector system is used in another predetermined milliseconds for detecting the isotope situated in the patient. Then the X-raying is reperformed for the first mentioned predetermined number of msec. This method provides a higher accuracy of determining the areas of the patient to be examined.

The method and the X-ray tube according to the invention may be varied in many ways without deviating from the scope of the invention. The X-ray tube may for instance be adapted to provide a cylindrical, annular or conical electron beam, which by intersecting with the anode provides an X-raying having the complete desired extension in radial direction.

We claim:

1. An X-ray tube for use in determining the electron density in a part volume from the scattering of X-rays received from several directions, said X-ray tube comprising a cathode, an anode which is symmetrical with respect to rotation about a predetermined axis and is positioned to receive a beam of electrons from said cathode, and means for causing the electron beam both to scan the anode in a radial direction with respect to said axis and to rotate about said axis, and wherein said anode is formed in the radial direction with steps, each step having a first surface which is directed towards the cathode deflection point or a point behind the cathode deflection point and a second surface which extends transversely of said first surface, whereby electrons are received by the anode on said second surfaces predominantly.

2. An X-ray tube as claimed in claim 1, wherein the anode is a transmission anode and said first surface of each step is substantially flat and defines a plane in which the cathode deflection point lies.

3. An X-ray tube as claimed in claim 1, wherein the anode is a reflection anode and is formed in such manner that it is substantially screened against undesired backward emission.

4. An X-ray tube as claimed in claim 1, wherein the steps are arranged in radially-extending rows, the steps of adjacent rows being mutually staggered.

5. An X-ray tube as claimed in claim 1, 2, 3 or 4, further comprising a collimator positioned to receive X-rays emitted from the anode, the collimator comprising a block of dense material formed with passages extending therethrough to focus X-rays upon a part volume under examination, each passage being defined by a central axis which passes through said first surface of one of said steps.

* * * * *